United States Patent [19]

Schott, Jr.

[11] 4,003,298

[45] Jan. 18, 1977

[54] APPARATUS FOR DRIVING MOVING WEBS IN BAG MAKING MACHINES

[75] Inventor: Charles M. Schott, Jr., Gloucester, Mass.

[73] Assignee: Gloucester Engineering Co. Inc., Gloucester, Mass.

[22] Filed: Feb. 9, 1976

[21] Appl. No.: 656,814

Related U.S. Application Data

[63] Continuation of Ser. No. 548,585, Feb. 10, 1975, abandoned.

[52] U.S. Cl. ..... 93/33 H; 93/8 R; 226/113

[51] Int. Cl.[2] ..... B31B 23/02

[58] Field of Search ..... 226/113, 114; 93/33 H, 93/33 R, 8 R, 35 R; 156/510, 515

[56] References Cited

UNITED STATES PATENTS

| | | | |
|---|---|---|---|
| 3,084,841 | 4/1963 | Hata et al. | 226/113 |
| 3,355,996 | 12/1967 | Medleycutt et al. | 93/33 H X |
| 3,526,563 | 9/1970 | Schott, Jr. | 226/113 X |
| 3,743,567 | 7/1973 | Abler | 93/8 R X |
| 3,877,628 | 4/1975 | Asselin et al. | 226/113 |
| 3,926,097 | 12/1975 | Santa Maria et al. | 226/113 X |

*Primary Examiner*—James F. Coan

[57] ABSTRACT

A machine for discontinuously driving a web moving continuously through the machine, having web pulling means, a web shuttle having the web trained thereabout, shuttle drive means for reciprocating the shuttle to alternately take up and pay out the web, and an endless looped belt drivingly interconnecting the web pulling means and the web shuttle for stopping and starting a portion of the belt associated with the web pulling means and thereby the web pulling means synchronously with the take-up and pay-out movements of the web and web shuttle, in which the web shuttle comprises a pair of shuttle members, a first upstream member and a second downstream member relative to the direction of web movement, each shuttle member being independently mounted in the machine for reciprocation, connected outside the loop of the belt to the shuttle drive means, and secured against the loop of the belt by the drive means for reciprocation of the shuttle members in unison, thereby stopping and starting the portion of the belt associated with the web pulling means and simultaneously stopping and starting the web.

21 Claims, 4 Drawing Figures

APPARATUS FOR DRIVING MOVING WEBS IN BAG MAKING MACHINES

This is a continuation, of application Ser. No. 548,585, filed Feb. 10, 1975, now abandoned.

This invention relates to web driving and more particularly to an improved shuttle system for imparting intermittent motion to a web continuously fed into a machine.

It is a principal object of this invention to adapt shuttle systems employed in discontinuously driving webs, particularly plastic webs, for positioning adjacent the end of a machine without extension therebeyond. It is a further object of this invention to permit the location of another machine adjacent a work station intermediate the shuttle ends without interference between the shuttle and the other machine. Another object of this invention is to maintain a predetermined transverse relationship of a shuttle roll to the web and to minimize lag between the ends of the shuttle roll during reciprocation from one end.

In general the invention features a machine for discontinuously driving a web moving continuously through the machine, the machine having web pulling means, a web shuttle mounted to the machine for reciprocation toward and away from the web pulling means, the web shuttle adapted to have the web trained thereabout, shuttle drive means for reciprocally moving the web shuttle to alternately take up and pay out the web, and an endless looped belt drivingly interconnecting the web pulling means and the web shuttle so that a portion of the belt associated with the web pulling means can stop and start interdependently with the take-up and pay-out movements of the web shuttle and synchronously with the take-up and pay-out of the web, thereby stopping and starting the web pulling means interdependently with the take-up and pay-out movements, in which the web shuttle comprises a pair of shuttle members, a first shuttle member positioned upstream and a second shuttle member positioned downstream relative to the direction of web movement through the machine, each shuttle member being independently mounted in the machine for reciprocation, a portion of the loop of the belt extending about each shuttle member, the shuttle drive means being connected to the shuttle members from outside those portions of the loop of the belt extending about the shuttle members, and the drive means synchronously securing the members against the portions of the loop of the belt for reciprocating the shuttle members in unison, thereby stopping and starting the portion of the belt associated with the web pulling means and simultaneously stopping and starting the web.

Preferred embodiments feature a flexible band connecting each shuttle member to the shuttle drive means; forming means adapted to impart a formation to the web, the shuttle drive means adapted to move the shuttle members in the take-up direction when the forming means are engaged with the web and to move the shuttle members in the pay-out direction when the forming means is released; a frame for maintaining the movement of the shuttle in a direction parallel to the path of the web, the frame comprising a pair of connecting arms pivotally mounted at one end to the shuttle on each side of the web, the arms extending in the same direction and parallel to the web path, a pair of rocker arms pivotally connected at one end to the opposite ends of each connecting arms, and a bar extending transversely of the web and rigidly connected to the opposite end of each rocker arm on each side of the web; a third shuttle member connected to and extending upstream of the first shuttle member, the web being trained about the third shuttle member, whereby movements of the pair of shuttle members are imparted to the third shuttle member and thereby to the web; first and second shuttle members positioned on one side of the machine and the third member elongated and extending across the machine transverse to the path of the web, and the frame for maintaining the shuttle movement parallel to the web path pivotally connected to each end of the third shuttle member to keep it in the transverse position; shuttle drive means comprising a hydraulic motor; the hydraulic motor comprising a double-acting hydraulic cylinder; the flexible bands connected to each end of the cylinder; an idler positioned between each of the first and second shuttle members and the cylinder, each idler being spaced from each shuttle member in the line of reciprocation of each shuttle member, and each band trained around each idler; the first shuttle member mounted for reciprocation in a plane parallel to the plane of the web extending from the web pulling means, and the second shuttle member mounted for reciprocation in a different plane from that of the first shuttle member; the plane of the second shuttle member being generally normal to the plane of the first shuttle member; forming means located downstream of the web pulling means, which comprise a pair of rolls forming a nip, and a platen roll positioned adjacent the forming means for supporting the web against engagement of the forming means, the platen roll being synchronously driven by the pair of web pulling rolls whereby the platen roll assists in the movement of the web away from the forming means; means for adjustably tensioning the loop of the belt; web pulling means comprising a pair of rotatable rolls forming a nip and a single-direction mechanical clutch adapted to permit rotation of the rolls in the web pulling direction and to prevent rotation of the rolls in the opposite direction; and forming means comprising a die adapted to heat soften and form a plastic web.

Other advantages and features of the invention will be apparent from the description and drawings herein of a preferred embodiment thereof.

Figure 1:
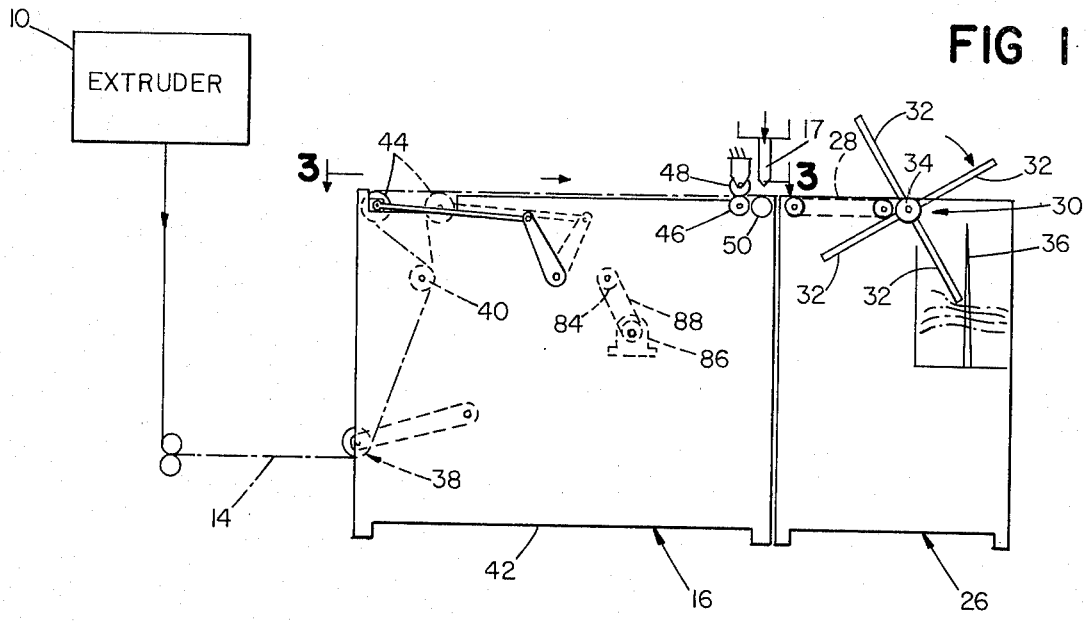
FIG. 1 is a somewhat diagrammatic, fragmentary side elevation of a preferred embodiment of the invention, shown in conjunction with an extruder and a wicketer.
Figure 2:
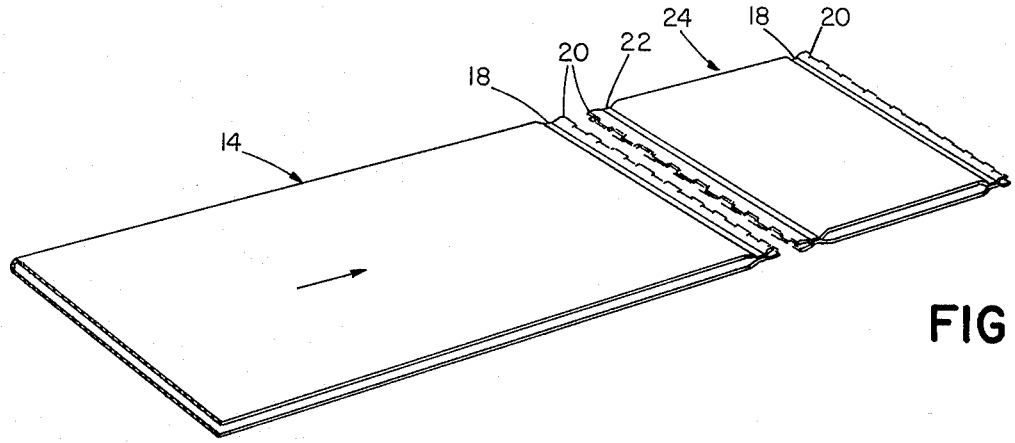
FIG. 2 is a perspective view of a web processed by a machine embodying the invention and of a sideweld bag made from the web with the invention.

There is shown in FIG. 1, apparatus for producing a continuous folded-over plastic film, apparatus for making severed sideweld bags from the film, and apparatus for stacking the discrete bags. An extruder 10 produces a plastic film such as polyethylene in the form of a folded-over sheet, shown in more detail in FIG. 2 as web 14, having one side folded and one side open relative to the direction of web travel shown by the arrow. Sideweld bag machine 16 periodically performs a combined cutting and sealing operation on the web transverse to its direction of travel. Thus seal bar 17 forms seal lines 18 and 22, and cuts the web at line 20 between the seal lines. The result is sideweld bag 24, having a folded bottom, heat sealed sides, and an open end for the top.

Figure 3:
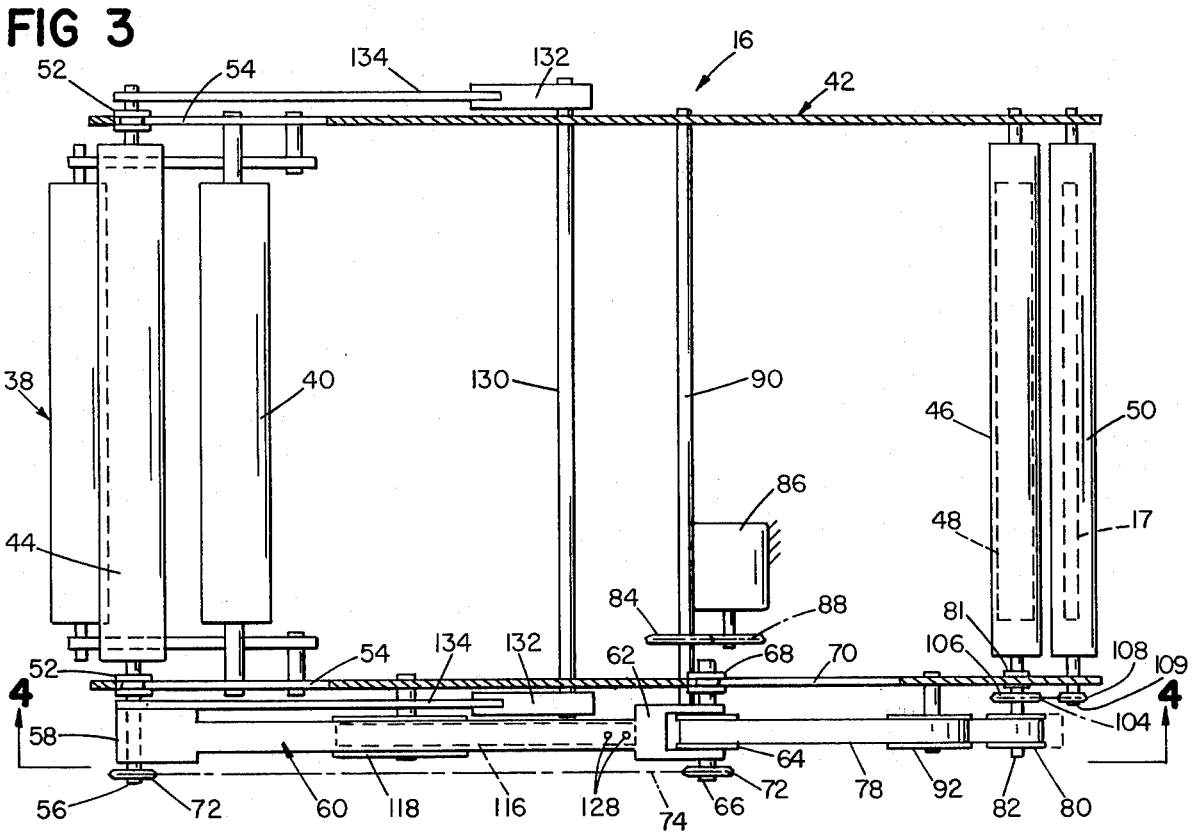
FIG. 3 is an enlarged plan view taken on lines 3—3 of FIG. 1, shown without the web.
Figure 4:
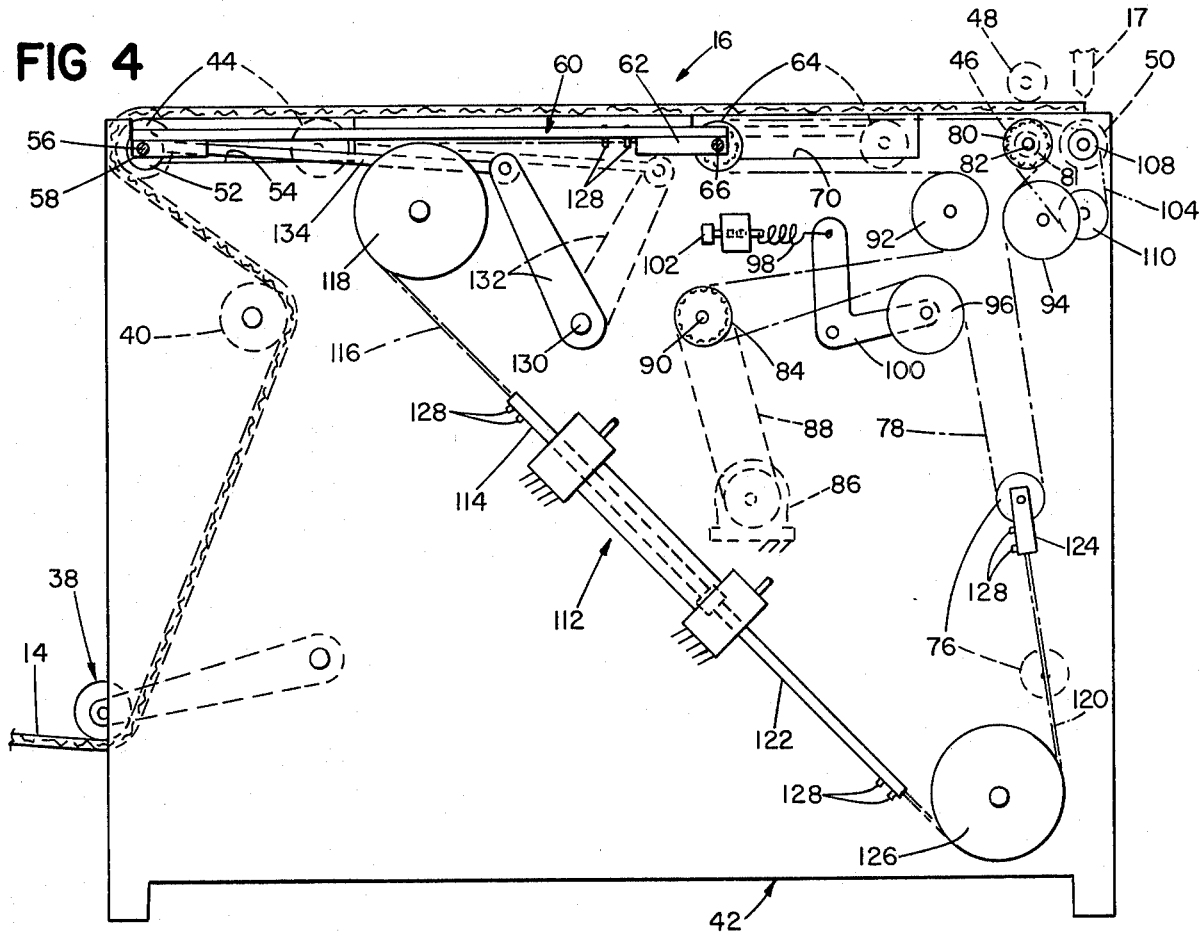
FIG. 4 is an enlarged side elevation of the embodiment of FIG. 1, taken on lines 4—4 of FIG. 3, with the web shown.

Referring to FIGS. 3 and 4, web 14 enters machine 16, passing under gravity-weighted dancer roll 38, around idler roll 40 mounted on housing 42, and thence around shuttle roll 44. Web 14 then extends to the right on top of the machine, through the nip formed by feed roll 46 and nip roll 48, and thence between seal bar 17 and platen roll 50. Rolls 46 and 50 are mounted in housing 42, and nip roll 48 and seal bar 17 are positioned above rolls 46 and 50, respectively.

Shuttle roll 44 reciprocates horizontally, shown in FIG. 4 in its maximum upstream position relative to the direction of web movement through the machine, with its maximum downstream position relative to the same web movement depicted in broken lines. Shuttle roll 44 is carried by wheels 52 upon straight line tracks 54 formed in housing 42. Shaft 56, carrying roll 44 and wheels 52, is connected to bearing block 58 located on one side of housing 42. Connected to and extending horizontally downstream of block 58 is push rod 60. Rod 60 has, at its downstream end, yoke 62, connected to an upstream shuttle sprocket 64 by sprocket shaft 66. Sprocket 64 reciprocates horizontally, shown in FIG. 4 in its maximum upstream position, with its maximum downstream position depicted in broken lines, rod 60 maintaining a fixed distance between shuttle roll 44 and upstream shuttle sprocket 64. Wheel 68, rotatably mounted on sprocket shaft 66, rides upon straight line track 70, thereby carrying sprocket 64. Shuttle roll sprockets 72, 72 are drivingly connected to the ends of shafts 56 and 66, respectively, and timing belt 74 is looped about both sprockets (FIG. 3).

A downstream shuttle sprocket 76 is located adjacent the downstream end of machine 16 and approximately midway between the top and bottom of housing 42. Sprocket 76 reciprocates approximately vertically, shown in FIG. 4 in its upstream (topmost) position, with its downstream (lowest) position depicted in broken lines. A timing belt 78 is looped about shuttle sprockets 64 and 76 and an outer feed roll sprocket 80. Sprocket 80 is drivingly connected to feed roll 46 by shaft 82. Drive sprocket 84 is included in the loop of belt 78 and supplies the power to move belt 78. Conventional electric motor 86 powers sprocket 84 through conventional linkage 88 and drive shaft 90. Belt 78 is positioned by fixed idlers 92 and 94 and moveable idler 96, all located outside of the loop of belt 78. Idler 96 is biased against belt 78 by tension spring 98 through pivotally mounted bell crank 100. The tension thereby put on belt 78 by spring 98 can be adjusted through bolt 102. Rotation of drive sprocket 84 is transmitted through belt 78 to upstream shuttle sprocket 64 and outer feed roll sprocket 80, thereby rotating feed roll 46 and also shuttle roll 44 through belt 74. An additional timing belt 104 is looped around inner feed roll sprocket 106, drivingly connected to shaft 82, platen roll sprocket 108, drivingly connected to platen roll 50 by shaft 109, and idler 110, thereby transmitting rotation of outer sprocket 80 to platen roll 50. Platen roll 50, when stationary, supports the web against engagement by seal bar 17, and when rotating, assists in movement of the web downstream away from seal bar 17.

A single-direction mechanical clutch 81, described in U.S. Pat. No. 3,526,,563, incorporated by reference herein, is mounted in housing 42 about shaft 82, permitting rotation of feed roll 46 in the web pulling direction (here, clockwise), while preventing rotation of roll 46 in the opposite direction, thereby providing accuracy of registration of the web and seal bar 17.

Synchronous reciprocation of shuttle roll 44, upstream shuttle sprocket 64, and downstream shuttle sprocket 76 is effected by double-acting hydraulic cylinder 112. Upstream piston rod 114 is connected to yoke 62 and thereby to upstream shuttle sprocket 64 by flexible stainless steel band 116 trained around fixed band idler 118 approximately 120°. Likewise, flexible stainless steel band 120 connects downstream piston rod 122 to yoke 124, which axially retains downstream sprocket 76. Band 120 is trained around fixed band idler 126 approximately 120°. Bands 116 and 120 are about 9 mils thick and about 3 inches wide. Cylinder 112 is positioned at about a 45° angle to the base of the machine, and idlers 118 and 126 are positioned in the line of reciprocation of their respective shuttle sprockets. Pins 128 attach the bands to the piston rods and yokes. Cylinder 112 is actuated by hydraulic means such as that described in U.S. Pat. No. 3,526,563, incorporated by reference herein.

Since shuttle roll 44 is reciprocated in a direction parallel to the path of the web by push rod 60 located only on one side of the web, apparatus is also provided to maintain the shuttle roll transverse to the web path throughout its reciprocation. Thus a torsion bar 130, rotatably mounted in housing 42, is rigidly connected to aligned rocker arms 132, 132 on each side of the machine. Connecting arms 134, 134 are pivotally connected to one end to rocker arms 132, 132 and are pivotally connected at their opposite ends to shuttle roll shaft 56. Thus the torsion bar, rocker arms and connecting arms act as a frame maintaining shuttle roll 44 in its position transverse to the web as shuttle roll 44 is reciprocated by push rod 60.

In operation, web 14 is trained through the machine as previously described. Dancer roll 38 acts to match the speed of motor 86 to the output speed of extruder 10. A suitable dancer assembly is described in U.S. Pat. No. 3,322,604, incorporated by reference herein. The surface speed of feed roll 46, driven by motor 86 through belt 78, is thus made to correspond to the speed of the web. Nip roll 48 can be very light in weight, and driven only through the frictional contact with the web and feed roll 46, as shown, or it can be driven by feed roll 46 through a separate driving belt, not shown.

When shuttle sprocket 64 is pulled by rod 114 of cylinder 112 through band 116 upstream from its downstream position (FIG. 4) at one half the speed at which web 14 is being fed to the machine at idler roll 40, shuttle roll 44 is pushed upstream from its downstream position because of the connection through push rod 60. At this speed of roll 44, the web extending from shuttle roll 44 across machine 16 through the nip 46, 48 to platen roll 50 is stationary, and at that time seal bar 17 can be actuated to seal and cut the stationary web.

Cylinder 112 is then actuated to move in the opposite direction so that rod 122 pulls shuttle sprocket 76 by means of band 120 downward to its downstream position. The take-up of belt 78 by shuttle sprocket 76 in one portion of the loop must be matched by a pay-out of belt 78 elsewhere along the loop, effected by the downstream motion of shuttle sprocket 64 back to its downstream position. When shuttle roll 44 is thereby moved to the right, back to its downstream position, the web extending from shuttle roll 44 to seal bar 17 moves rapidly, being pulled by the pair of rolls 46, 48, causing the next section of web to move past seal bar 17 until shuttle roll 44 again reverses direction. The stroke length of cylinder 112 can be adjusted to vary the machine repeat length, in which case the travel of sprockets 64 and 76 will be varied. Apparatus for regulating the speed and stroke length of cyliner 112 is described in U.S. Pat. No. 3,526,563, incorporated by reference herein.

Feed roll 46 is driven in direct relation to the action of shuttle roll 44. When shuttle sprocket 64 is moving upstream from its downstream position, stopping the web at bar 17, the portion of belt 78 from sprocket 64 around outer feed roll sprocket 80 to sprocket 76 is stationary, thereby stopping feed roll 46, and platen roll 50, by virtue of the stopping of belt 104. Seal bar 17 is then lowered to heat seal and sever the plastic web by mechanism not shown here but described in U.S. Pat. No. 3,361,614, which is hereby incorporated by reference.

When sprocket 64 is pulled downstream back to its downstream position because of the pulling of sprocket 76 downward, the portion of belt 78 from sprocket 64 around outer feed roll sprocket 80 to sprocket 76 moves, causing feed roll 46, and thus nip roll 48, to rotate, pulling web 14 as it is being paid out by the downstream movement of shuttle roll 44. Sprocket 64, rotated by motor 86 through linkage 88, drive sprocket 90, and belt 78, transmits rotation to shuttle roll sprocket 72 through belt 74, and thereby to shuttle roll 44. The sprocket sizes are arranged so that the surface speed of roll 44 is the same as that of feed roll 46. The relative diameters of inner feed roll sprocket 106 and platen roll sprocket 108 are arranged so that platen roll 50 rotates slightly faster than feed roll 46. This is done in order to free seal bar 17 from platen roll 50, if seal bar 17 should stick to roll 50.

The tensioning apparatus comprising idler 96, bell crank 100, tension spring 98, and bolt 102 keeps belt 78 in tension, thus keeping the motion of shuttle sprockets 64 and 76 synchronized, bolt 102 permitting adjustment of the tension to make belt 78 more or less taut. The guide apparatus comprising torsion bar 130, rocker arms 132, 132, and connecting arms 134, 134, keeps shuttle roll 44 square throughout its reciprocation. Clutch 81 prevents feed roll 46 from rotating in the counterclockwise direction, the effect of which would be to back up web 14 and distort the web repeat length.

Since the shuttle sprockets 64 and 76 are not ridigly connected to each other, their relative positions in the machine can be varied, so long as they are both connected to the double-acting cylinder and a portion of belt 78 long enough to train about outer feed roll sprocket 80 is maintained between the two shuttle sprockets. In all cases, the downstream end of the shuttle need not extend beyond feed roll 46 in the downstream direction.

If desired, a wicketer 26 (FIG. 1) for stacking bags 24 can be placed directly abutting the part of machine 16 where heat-sealing and severing by seal bar 17 occur. Wicketer 26 has conveyor belt 28, which carries bags 24 away from bag machine 16. Wicketer wheel 30, comprising radial arms 32 mounted on shaft 34, is rotatably positioned adjacent belt 28. Arms 32 have holes (not shown) spaced along their upper face, and a vacuum creates a suction effect into the holes. When an arm 32, rotating clockwise on shaft 34, moves into the horizontal leftward position, it is located alongside of belt 28 and directly underneath a portion of bag 24, which is wider in the transverse direction than both belt 28 and arm 32. Arm 32, continuing to move clockwise, engages the overhanging portion of bag 24 by virtue of the suction effect of the holes in arm 32, and carries bag 24 clockwise until it reaches the horizontal rightward position. There arm 32, continuing to move downward, impales the overhanging portion of bag 24 on stacking spike 36, located alongside of the path of arm 32. At the same time the vacuum is released so that arm 32 pulls away from the spiked bag, and is ready to pick up another bag as the process is repeated. The result is a stack of bags ready for handling by an end user.

Other machines besides wicketer 26 can be placed directly abutting seal bar 17 such as various forms of delivery systems or packaging systems. Likewise additional operations can be performed on a web in a working zone on the top of machine 16 from the extreme downstream point of shuttle roll 44 to nip 46, 48. Such operations could include printing on the web or forming handles on bags. It should be noted that machine 16 need not be a sideweld bag-making machine, or a bag machine at all, as the invention can be used in other web processing operations having a discontinuous output, such as formation of polystyrene cups.

Other embodiments within the invention will be apparent to those skilled in the art.

What is claimed is:

1. In a machine for discontinuously driving a web moving continuously through the machine, said machine having web pulling means, a web shuttle mounted to said machine for reciprocation toward and away from said web pulling means, said web shuttle adapted to have said web trained thereabout, shuttle drive means for reciprocally moving said web shuttle to alternately take up and pay out said web, and an endless looped belt drivingly interconnecting said web pulling means and said web shuttle so that a portion of said belt associated with said web pulling means can stop and start interdependently with the take-up and pay-out movements of said web shuttle and synchronously with the take-up and pay-out of said web, thereby stopping and starting said web pulling means interdependently with said take-up and pay-out movements, the improvements in which:

said web shuttle comprises a pair of shuttle members, a first said shuttle member positioned upstream and a second said shuttle member positioned downstream relative to the direction of web movement through said machine, each said shuttle member being independently mounted in said machine for reciprocation, a portion of the loop of said belt extending about each said shuttle member, said shuttle drive means being connected to said shuttle members from outside said portions of the loop of said belt extending about said shuttle members, and said drive means synchronously securing said members against said portions of the loop of said belt for reciprocating said shuttle members in unison, thereby stopping and starting said portion of said belt associated with said web pulling means and simultaneously stopping and starting said web.

2. The machine of claim 1 wherein a flexible band connects each said shuttle member to said shuttle drive means.

3. The machine of claim 1 further comprising forming means adapted to impart a formation to said web, said shuttle drive means adapted to move said shuttle members in the take-up direction when said forming means is engaged with the web and to move said shuttle members in the pay-out direction when said forming means is released.

4. The machine of claim 1 further comprising a frame for maintaining the movement of said shuttle in a direction parallel to the path of said web, said frame comprising a pair of connecting arms pivotally mounted at one end to said shuttle on each side of said web, said arms extending in the same direction and parallel to said web path, a pair of rocker arms pivotally connected at one end to the opposite ends of said connecting arms, and a bar extending transversely of said web rigidly connected to the opposite end of each said rocker arm on each side of said web.

5. The machine of claim 1 wherein said shuttle further comprises a third shuttle member connected to and extending upstream of said first shuttle member, said web being trained about said third member, whereby movements of said pair of shuttle members are imparted to said third shuttle member and thereby to said web.

6. The machine of claim 5 wherein said first and second shuttle members are positioned on one side of said machine and said third member is elongated and extends across said machine transverse to the path of said web, and said machine further includes a frame for maintaining said third shuttle member in said transverse position throughout its reciprocation, said frame comprising a pair of connecting arms pivotally connected at one end to each end of said third shuttle member, both said connecting arms extending in the same direction and parallel to said web path, a pair of rocker arms pivotally connected to the opposite ends of said connecting arms, and a bar extending transversely of said web path and rigidly connected to the opposite end of each said rocker arm on each side of said web.

7. The machine of claim 1 wherein said shuttle drive means comprises a hydraulic motor.

8. The machine of claim 7 wherein said motor comprises a double-acting hydraulic cylinder.

9. The machine of claim 8 wherein a first flexible band connects said first shuttle member to one end of said cylinder and a second flexible band connects said second shuttle member to the opposite end of said cylinder.

10. The machine of claim 9 wherein an idler is positioned between each of said first and second shuttle members and said cylinder, each said idler being spaced from each said shuttle member in the line of reciprocation of each said shuttle member, and each said band is trained around each said idler.

11. The machine of claim 10 wherein said first shuttle member is mounted for reciprocation in a plane parallel to the plane of said web extending from said first shuttle member to said web pulling means and said second shuttle member is mounted for reciprocation in a different plane from said plane of said first shuttle member.

12. The machine of claim 11 wherein said different plane is generally normal to said plane of said first shuttle member.

13. The machine of claim 3 wherein said forming means are located downstream of said web pulling means, said web pulling means comprise a pair of rolls forming a nip, and said machine further includes a platen roll positioned adjacent said forming means for supporting said web against said engagement of said forming means, said platen roll being synchronously driven by said pair of web pulling rolls whereby said platen roll assists in the movement of said web away from said forming means.

14. The machine of claim 1 further comprising means for adjustably tensioning said loop of said belt.

15. The machine of claim 1 wherein said web pulling means comprising a pair of rotatable rolls forming a nip and said machine includes a single-direction mechanical clutch adapted to permit rotation of said rolls in the web pulling direction and to prevent rotation of said rolls in the opposite direction.

16. In a machine for heat-forming articles from a running length of plastic, said machine having a die adapted to heat soften and form the plastic, a platen roll positioned adjacent said die for supporting said plastic for engagement with said die, a pair of rolls forming a nip adapted to engage and pull said plastic through the machine, said die located downstream of said nip rolls relative to the direction of movement of said plastic and adjacent the downstream end of said machine, a shuttle mounted to said machine for reciprocation toward and away from said pair of nip rolls, said shuttle adapted to have said plastic trained thereabout, shuttle drive means for reciprocally moving said shuttle to alternately take up said plastic and to pay out said plastic, and an endless looped belt drivingly interconnecting said nip rolls and said shuttle so that a portion of said belt associated with said nip rolls can stop and start interdependently with the take-up and pay-out movements of said shuttle and synchronously with the take-up and pay-out of said plastic, thereby stopping and starting said nip rolls interdependently with said take-up and pay-out movements, the improvement in which:

said web shuttle comprises a pair of shuttle members, a first said shuttle member positioned upstream and a second said shuttle member positioned downstream relative to the direction of movement of said plastic through said machine, each said shuttle member being independently mounted in said machine for reciprocation, a portion of the loop of said belt extending about each said shuttle member, said shuttle drive means being connected to said shuttle members from outside said portions of the loop of said belt extending about said shuttle members, said drive means synchronously securing said members against said portions of the loop of said belt for reciprocating said shuttle members in unison, thereby stopping and starting said portion of said belt associated with said nip rolls and simultaneously stopping and starting said plastic to stop said plastic while said die is engaged with said plastic and to start said plastic while said die is released therefrom, and said platen roll is synchronously driven by said nip rolls whereby said platen roll assists in the movement of said formed plastic away from said die.

17. The machine of claim 16 wherein said shuttle drive means comprises a double-acting hydraulic cylinder, said machine further comprising a flexible band for connecting each end of said cylinder to each said shuttle member and a pair of idlers, each said idler being positioned between one shuttle member and one end of said cylinder and located in the line of reciprocation of each said shuttle member, each said band being respectively trained about each said idler.

18. The machine of claim 17 wherein said first shuttle member is mounted for reciprocation in a plane parallel to the plane of said plastic extending from said first shuttle member to said nip rolls and said second shuttle member is mounted for reciprocation in a different plane from said plane of said first shuttle member.

19. The machine of claim 18 wherein said different plane is generally normal to said plane of said first shuttle member.

20. In a machine for discontinuously driving a web moving continuously through the machine, said machine having web pulling means, a web shuttle mounted to said machine for reciprocation toward and away from said web pulling means, said web shuttle adapted to have said web trained thereabout, shuttle drive means for reciprocally moving said web shuttle to alternately take up and pay out said web, and an endless looped belt drivingly interconnecting said web pulling means and said web shuttle so that a portion of said belt associated with said web pulling means can stop and start interdependently with the take-up and pay-out movements of said web shuttle and synchronously with the take-up and pay-out of said web, thereby stopping and starting said web pulling means interdependently with said take-up and pay-out movements, the improvement in which:

said shuttle comprises a pair of shuttle members, a first said shuttle member positioned upstream and a second said shuttle member positioned downstream relative to the direction of web movement through said machine, each said shuttle member being independently mounted in said machine for reciprocation, a portion of the loop of said belt extending about each said shuttle member, said shuttle drive means being connected to said shuttle members, and said drive means synchronously securing said members against said portions of the loop of said belt for reciprocating said shuttle members in unison, thereby stopping and starting said portion of said belt associated with said web pulling means and simultaneously stopping and starting said web.

21. The machine of claim 20 wherein said web moves in a feed line to a work station located downstream of said machine, said downstream shuttle member being mounted for reciprocation outside of the portion of said feed line between said web pulling means and said work station, enabling close placement of said work station of feeding means of said machine.

* * * * *